United States Patent [19]

Crawford

[11] 4,179,457

[45] Dec. 18, 1979

[54] CONVERSION OF FATTY ACID ESTERS TO FATTY ACIDS

[75] Inventor: Richard R. Crawford, Pittsford, N.Y.

[73] Assignee: Eastman Kodak Company, Rochester, N.Y.

[21] Appl. No.: 974,281

[22] Filed: Dec. 29, 1978

[51] Int. Cl.[2] ..... C11C 1/04; C11D 13/00

[52] U.S. Cl. ..... 260/418; 260/413; 260/415; 260/417; 260/424

[58] Field of Search ..... 260/413 S, 413 R, 415, 260/417, 418, 424

[56] References Cited

U.S. PATENT DOCUMENTS

| | | | |
|---|---|---|---|
| 2,731,495 | 1/1956 | Emslie | 260/424 |
| 2,877,249 | 3/1959 | Kelley | 260/418 |
| 3,642,844 | 2/1972 | Forbes | 260/418 |

*Primary Examiner*—John F. Niebling

*Attorney, Agent, or Firm*—John F. Stevens; Daniel B. Reece, III

[57] ABSTRACT

A process is disclosed for converting lower alkyl esters of fatty acids to the corresponding fatty acids by the steps of sequentially dissolving the esters in a solvent, saponifying the solution, acidifying the solution to a pH of between about 5 and about 8, distilling to remove solvents, and again acdifying the solution to a pH of between about 1 and about 4. The acids may then be removed by washing.

10 Claims, No Drawings

CONVERSION OF FATTY ACID ESTERS TO FATTY ACIDS

BACKGROUND OF THE INVENTION

1. Field of the Invention

This invention relates to a process for converting lower alkyl esters of fatty acids to the corresponding fatty acids by a two-stage acidification process.

2. Description of the Prior Art

Lower alkyl esters of fatty acids may be formed in a number of ways. As an example, lower alkyl esters of fatty acids are formed as a by-product when vegetable oil deodorizer distillate is processed in a conventional manner to obtain tocopherols. It is often desirable to obtain the corresponding fatty acids from these esters. Prior attempts to derive acids from these esters have involved removal of the solvent by distillation prior to acidification. This has led to objectional foaming of the reaction mixture. In other attempts to obtain the fatty acids from the corresponding fatty acid esters, removal of the solvents by distillation after acidification has been found to result in considerable re-esterification which, of course, is objectionable. It has now been found that by the proper use of a two-stage acidification with intermediate distillation, fatty acids can be derived from these esters efficiently. The fatty acids so-derived have utility in a number of fields, e.g., in the manufacture of plasticizers, surfactants, lubricants, heat and light stabilizers, etc., as is well known in the art.

SUMMARY OF THE INVENTION

In accordance with this invention, lower alkyl esters of fatty acids having from 10 to 22 carbon atoms are converted to the corresponding fatty acid by a process which comprises sequentially dissolving the esters in a solvent of water and alcohol, saponifying the ester solution, mixing an acidic substance with the solution to lower the pH to between about 5 and 8, removing solvents by distillation, mixing additional acidic substance with the solution to lower the pH to between about 1 and 4, and finally washing the reaction product to obtain the fatty acid.

DETAILED DESCRIPTION OF THE INVENTION

The process according to this invention more specifically comprises the steps of (a) dissolving the esters in a solvent of about 100 parts water and from about 25 to about 300 parts by volume of a lower alcohol, (b) saponifying the ester solution with an alkali metal hydroxide, (c) mixing a sufficient quantity of an acidic substance with the solution to lower the pH to between about 5 and about 8, (d) distilling the mixture to remove solvent, (e) mixing additional acidic substance with the solution to lower the pH thereof to between about 1 and about 4, and (f) washing the reaction product to obtain the fatty acid.

The esters used as a starting material are lower alkyl (from 1 to 4 carbon atoms) esters of fatty acid having from 10 to 22 carbon atoms and are usually methyl or ethyl esters or mixtures thereof. These fatty acids include, among others, palmitic, stearic, oleic, linoleic, linolenic and behenic acids, together with such acids as capric, lauric, myristic, palmitoleic and arachidic acids.

The first step of the process includes saponification of the esters in solution with an alkali metal hydroxide, preferably sodium hydroxide, potassium hydroxide or mixtures thereof. The solvent selected should provide a suitable viscosity of the solution. Preferred solvents include mixtures of lower alcohols and water, especially methanol and water and ethanol and water, using from about 25 to about 300 parts alcohol by volume per 100 parts water. Saponification is carried out at reflux, normally for a period of 15–60 minutes using about 15 to about 30 parts by weight alkali metal hydroxide per 100 parts fatty acid ester at a temperature of between about 60° and about 90° C., with 70°–85° C. preferred. The solution preferably is mildly agitated during saponification.

Following saponification, the fatty acid esters are acidified, by adding to the solution a sufficient quantity of strong acid to lower the pH of the solution to between about 5 and about 8, preferably between about 6 and about 7. Hydrochloric, sulfuric and phosphoric acids are preferred for this acidification step.

Following the first acidification step, distillation is carried out to remove substantially all of the solvent from the solution. Distillation is accomplished by heating to a temperature of between about 65° and about 85° C., normally at atmospheric or sub-atmospheric pressure for a sufficient length of time to remove substantially all of the solvent.

The second stage of acidification is accomplished in generally the same manner as the first stage, again using a strong acid. This time, however, the solution is carried to a pH of between about 1 and about 4, preferably to between about 1.5 and about 2.5. The spent acid is then removed, and the saponification mixture is purified, preferably by washing with water. The fatty acids are obtained at purities of 85–99%, most commonly between about 90 and about 95%.

The following examples are submitted for a better understanding of the invention.

EXAMPLE 1

A 1-liter reactor fitted with an agitator and reflux condenser, and containing a solution of 200 ml. (175.7 g.) methyl esters in 100 ml. methyl alcohol, is added a solution of 25 g. sodium hydroxide in 100 ml. water. The methyl esters are mixtures of esters of fatty acids having from 14 to 22 carbon atoms. The mixture is refluxed for one hour at which time 40 ml. hydrochloric acid (37%) is added to lower the pH to between 6 and 7. Distillate (105 ml.) is removed at 84° C. and atmoshperic pressure. Twenty ml. of additional hydrochloric acid is added to lower the pH to about 2. The spent acid is removed, and the saponification mixture is washed four times with water at 80°–90° C. The product (166 g.) after degassing comprises:

| | |
|---|---|
| Esters | 1% |
| Acid Value | 185 |
| Non-Saponified Product | 4.4% |

Fatty Acid Distribution in Product

| No. Cs in Acid | % |
|---|---|
| 14 | 0.2 |
| 16 | 6.9 |
| 18 | 91.3 |
| 20 | 0.4 |

-continued

| | | |
|---|---|---|
| | 22 | 1.2 |

EXAMPLE 2—(Control)

Methyl esters, 200 ml. (174.8 g.) are added to a mixture of 100 ml. water and 100 ml. of methanol in which is dissolved 25 g. sodium hydroxide. The solution is refluxed for 1 hr. Attempts to remove the methanol by direct distillation result in foaming to such a degree that distillation has to be ceased.

The mixture is then acidified with 70 ml hydrochloric acid to a pH of about 2 after which 102 ml. solvent is removed by distillation. The reaction product is then washed four times with water and degassed. The final product (166.1 g) contains 11.5% ester as determined by infrared spectroscopy.

Unless otherwise specified, all parts, percentages, ratios, etc., are on a weight basis.

The invention has been described in detail with particular reference to preferred embodiments thereof, but it will be understood that variations and modifications can be effected within the spirit and scope of the invention.

I claim:

1. Process for obtaining fatty acids from the lower alkyl esters of said acids which comprises the steps of (a) dissolving said esters in a solvent consisting essentially of water and from about 25 to about 300 parts by weight of a lower alcohol, (b) saponifying said ester solution with an alkali metal hydroxide, (c) mixing a sufficient quantity of an acidic substance with said solution to lower the pH to between about 5 and about 8, (d) distilling the mixture to remove solvent therefrom, (e) mixing additional acidic substance with the mixture to lower the pH thereof to between about 1 and about 4, and (f) washing the reaction product to obtain said fatty acid.

2. Process according to claim 1 wherein the lower alcohol is methanol or ethanol.

3. Process according to claim 1 wherein said alkali metal hydroxide is selected from sodium hydroxide, potassium hydroxide, and mixtures of sodium and potassium hydroxide.

4. Process according to claim 1 wherein from about 15 to about 30 parts by weight alkali metal hydroxide per 100 parts fatty acid ester are used.

5. Process according to claim 1 wherein the acidification prior to the distillation step lowers the pH of the solution to between about 6 and about 7.

6. Process according to claim 1 wherein the acidification following distillation lowers the pH to between about 1.5 and about 2.5.

7. Process according to claim 1 wherein substantially all the solvent is removed during distillation.

8. Method of obtaining fatty acids from mixtures of methyl and ethyl esters of said acids which comprises the steps of (a) dissolving said esters in a solvent consisting essentially of water and from about 25 to about 300 parts by weight of an alcohol selected from methanol and ethanol, (b) saponifying said ester solution with an alkali metal hydroxide selected from sodium hydroxide, potassium hydroxide and mixtures thereof, (c) mixing a sufficient quantity of an acidic substance with said solution to lower the pH to between about 5 and about 8, (d) distilling the mixture to remove solvent therefrom, (e) mixing additional acidic substance with said solution mixture to lower the pH thereof to between about 1 and about 4, and (f) washing the reaction product to obtain said fatty acid.

9. Method of obtaining fatty acids from mixtures of methyl and ethyl esters of said acids which comprises the steps of (a) dissolving said esters in a solvent consisting essentially of water and from about 25 to about 300 parts by weight of an alcohol selected from methanol and ethanol, (b) saponifying said ester solution with an alkali metal hydroxide selected from sodium hydroxide, potassium hydroxide and mixtures thereof, (c) mixing a sufficient quantity of an acidic substance with said solution to lower the pH to between about 5 and about 8, (d) distilling the mixture to remove solvent therefrom, (e) mixing additional acidic substance with said solution to lower the pH thereof to between about 1 and about 4, and (f) washing the reaction product to obtain said fatty acid.

10. Method of obtaining fatty acids from mixtures of methyl and ethyl esters of said acids which comprises the steps of (a) dissolving said esters in a solvent consisting essentially of water and from about 25 to about 300 parts by weight of an alcohol selected from methanol and ethanol, (b) saponifying said ester solution with an alkali metal hydroxide selected from sodium hydroxide, potassium hydroxide and mixtures thereof, (c) mixing a sufficient quantity of an acidic substance with said solution to lower the pH to between about 6 and about 7, (d) distilling the mixture to remove substantially all the solvent therefrom, (e) mixing additional acidic substance with said solution to lower the pH thereof to between about 1.5 and about 2.5, and (f) washing the reaction product to obtain said fatty acid.

* * * * *